US010612733B2

(12) United States Patent
Xiang et al.

(10) Patent No.: US 10,612,733 B2
(45) Date of Patent: Apr. 7, 2020

(54) MODULAR LIGHT SYSTEM

(71) Applicant: MAXLITE, INC., West Caldwell, NJ (US)

(72) Inventors: Jun Xiang, Parsippany, NJ (US); Jiwan Kim, Cheongju-si (KR)

(73) Assignee: MAXLITE, INC., West Caldwell, NJ (US)

( * ) Notice: Subject to any disclaimer, the term of this patent is extended or adjusted under 35 U.S.C. 154(b) by 151 days.

(21) Appl. No.: 15/971,627

(22) Filed: May 4, 2018

(65) Prior Publication Data

US 2018/0320838 A1 Nov. 8, 2018

Related U.S. Application Data

(60) Provisional application No. 62/503,066, filed on May 8, 2017.

(51) Int. Cl.

| | |
|---|---|
| ***F21S 2/00*** | (2016.01) |
| ***F21V 29/76*** | (2015.01) |
| ***F21V 23/06*** | (2006.01) |
| ***F21V 23/00*** | (2015.01) |
| ***F21V 23/04*** | (2006.01) |
| ***F21Y 115/15*** | (2016.01) |
| ***F21Y 115/10*** | (2016.01) |
| ***F21Y 101/00*** | (2016.01) |

(52) U.S. Cl.

CPC ..... *F21S 2/005* (2013.01); *F21V 23/003* (2013.01); *F21V 23/0442* (2013.01); *F21V 23/0464* (2013.01); *F21V 23/06* (2013.01); *F21V 29/76* (2015.01); *F21Y 2101/00* (2013.01); *F21Y 2115/10* (2016.08); *F21Y 2115/15* (2016.08)

(58) Field of Classification Search

CPC ..... F21S 2/005; F21V 29/76; F21V 23/003; F21V 23/0442; F21V 23/0464; F21V 23/06

USPC ..... 362/235

See application file for complete search history.

(56) References Cited

U.S. PATENT DOCUMENTS

| | | | | |
|---|---|---|---|---|
| 9,353,924 | B2 * | 5/2016 | Scarlata | F21S 9/00 |
| 9,605,819 | B2 * | 3/2017 | Jiang | F21K 9/00 |
| 10,352,542 | B2 * | 7/2019 | Tsai | F21V 29/763 |
| 2005/0265051 | A1 * | 12/2005 | Yamamoto | F21S 2/005 362/657 |
| 2009/0009997 | A1 * | 1/2009 | Sanfilippo | F21S 2/005 362/244 |

(Continued)

*Primary Examiner* — Bryon T Gyllstrom

(74) *Attorney, Agent, or Firm* — Budzyn IP Law, LLC

(57) ABSTRACT

A modular light system comprising a light module comprising a heat sink having a first side with a first mechanical coupling and a second side with a second mechanical coupling, a solid-state light emitting component connected to the heat sink, and a junction box with a first electrical coupling and a second electrical coupling, at least one being electrically connected to the solid-state light emitting component. The modular light system further comprises a base module removably connected to the first side by the first mechanical coupling and the first electrical coupling, and having a connection for power input to the modular light system to provide power to the solid-state light emitting component. A head module is removably connected to the second side by the second mechanical coupling and the second electrical coupling, and has a power terminal end connector.

29 Claims, 8 Drawing Sheets

(56) References Cited

U.S. PATENT DOCUMENTS

| | | | | |
|---|---|---|---|---|
| 2009/0168422 | A1* | 7/2009 | Chiu | F21S 2/005 362/249.03 |
| 2009/0237936 | A1* | 9/2009 | Ku | F21S 2/005 362/249.14 |
| 2011/0285314 | A1* | 11/2011 | Carney | E04B 9/006 315/294 |
| 2011/0286207 | A1* | 11/2011 | Chan | F21V 15/013 362/217.1 |
| 2012/0057357 | A1* | 3/2012 | Kim | F21S 2/005 362/373 |
| 2012/0106152 | A1* | 5/2012 | Zheng | F21S 2/005 362/249.02 |
| 2012/0230030 | A1* | 9/2012 | Miller | F21S 2/005 362/249.01 |
| 2016/0047538 | A1* | 2/2016 | Peck | F21S 2/005 362/249.02 |

* cited by examiner

MODULAR LIGHT SYSTEM

CROSS-REFERENCE TO RELATED APPLICATION

This application claims priority to U.S. Provisional Patent Application No. 62/503,066 filed May 8, 2017, the contents of which are incorporated by reference herein.

FIELD OF THE INVENTION

The present invention relates to improvements to modular light systems.

BACKGROUND OF THE INVENTION

The cost, reliability and energy efficiency of solid-state light emitting devices such as light emitting diodes (LEDs) make such devices a desirable alternative to traditional incandescent, halogen, and other types of light sources. Whether for a new installation, upgrade, conversion or expansion, LED light systems are often the first and best choice for a variety of installation scenarios. However, repair and replacement of faulty or failed components of LED light systems may present issues not associated with other, more traditional types of lighting. For example, incandescent and halogen bulbs are easily replaced. While the cost per-bulb varies based upon size and other parameters, it is usually possible to replace a faulty bulb without having to replace the entire fixture or light system. LED light systems present different issues when it comes to repair and replacement because the light source—typically a plurality of LEDs secured to a printed circuit board—is not an individual component, but rather is comprised of a plurality of different components (e.g., a plurality of LEDs, a printed circuit board, drive circuitry, etc.). When a component in an LED light system fails, it is not uncommon to have to replace the entire system rather than simply the failed component.

Modularity is also an important consideration for new installations, upgrades, conversions or expansions. The ability to provide a light system that is configurable to accommodate various installation size requirements is desirable. For example, for design aesthetics it may be desirable to provide the same light system in a plurality of different sizes. It is also desirable to be able to configure a light system in real-time to accommodate installation constraints.

A modular light system to the assignee herein may be found in U.S. patent application Ser. No. 15/364,461, filed on Nov. 30, 2016, the entire contents of which are incorporated by reference herein.

SUMMARY OF THE INVENTION

The present invention is directed to a modular light system that overcomes the above-described shortcomings in the art. Specifically, in accordance with an embodiment of the present invention, a modular light system is provided that is more flexibly configurable, enabling easy installation, configuration and service. The present invention eliminates the need to discretely wire a plurality of solid-state light modules to assemble a solid-state light system. The present invention advantageously includes mechanical and electrical couplings that make it easy to assemble and disassemble all or part of the inventive modular light system. When assembling, any number of light modules may be mechanically and electrically coupled and connected together by simply coupling complementarily sized and shaped electrical and mechanical couplings on light modules to be assembled together. A head module and a base module, each equipped with similar electrical and mechanical couplings complete the inventive modular light system by bookending the one or more light modules and by providing the necessary electrical and mechanical connections to secure the light modules together and to provide power to the solid-state light emitting components of the light modules. The present invention greatly eases design, configuration, assembly, disassembly, installation, expansion, repair, replacement, retrofit, etc., of light systems for any number of types of installations and applications.

A first embodiment of the present invention is directed to a modular light system comprising a light module comprising a heat sink having a first side with a first mechanical coupling and a second side with a second mechanical coupling, a solid-state light emitting component connected to the heat sink, and a junction box with a first electrical coupling and a second electrical coupling, at least one being electrically connected to the solid-state light emitting component. The modular light system further comprises a base module removably connected to the first side by the first mechanical coupling and the first electrical coupling, the base module having a connection for power input to the modular light system to provide power to the solid-state light emitting component, and a head module removably connected to the second side by the second mechanical coupling and the second electrical coupling, the head module having a power terminal end connector connectable with the second electrical coupling.

The present invention is further directed to a modular light system wherein the first mechanical coupling comprises an aperture defined in the first side of the heat sink and a lock extending at least partially into the aperture.

The present invention is further directed to a modular light system wherein the second mechanical coupling comprises a guide pin extending from the second side of the heat sink.

The present invention is further directed to a modular light system wherein the first electrical coupling is one of a plug and a receptacle, and the second electrical coupling is the other one of a plug and a receptacle.

The present invention is further directed to a modular light system wherein the first electrical coupling is a plug, and the second electrical coupling is a receptacle.

The present invention is further directed to a modular light system wherein the light module further comprises a lens and a gasket connectable to the heat sink to sealingly cover the solid-state light emitting component.

The present invention is further directed to a modular light system further comprising a plurality of solid-state light emitting components.

The present invention is further directed to a modular light system further comprising a mount connected to the base module to secure the modular light system to a support. The mount comprises one of a wall pack mount, a knuckle surface mount, a knuckle slip-fit mount, a pole mount and a trunnion mount.

The present invention is further directed to a modular light system further comprising a sensor in the base module and configured to detect changes in an environmental condition. The sensor may be configured to detect changes in ambient light.

The present invention is further directed to a modular light system further comprising drive circuitry in the head module.

The present invention is further directed to a modular light system further comprising control circuitry in the base module.

A second embodiment of the present invention is directed to a modular light system comprising at least a first and second light module. The first light module comprising a first heat sink having a first side with a first mechanical coupling and a second side with a second mechanical coupling, a first solid-state light emitting component connected to the first heat sink, and a first junction box with a first electrical coupling and a second electrical coupling, at least one being electrically connected to the first solid-state light emitting component. The second light module comprising, a second heat sink having a first side with a first mechanical coupling connected to the second mechanical coupling of the second side of the first heat sink, and a second side with a second mechanical coupling, a second solid-state light emitting component connected to the second heat sink, and a second junction box with a first electrical coupling connected with the second electrical coupling of the first junction box, and a second electrical coupling, at least one being electrically connected to the second solid-state light emitting component. The modular light system of this embodiment further comprises a base module removably connected to the first side of the first light module by the first mechanical coupling and the first electrical coupling, the base module having a connection for power input to the modular light system to provide power to the first solid-state light emitting component, and a head module removably connected to the second side of the second light module by the second mechanical coupling and the second electrical coupling, the head module having a power terminal end connector connectable with the second electrical coupling.

DESCRIPTION OF THE DIAGRAMS

Embodiments of the present invention will now be described with reference to the following diagrams, wherein.

DETAILED DESCRIPTION OF THE INVENTION

The present invention is directed to a modular light system that provides increased flexibility for configuring, installing, retrofitting and repairing light systems.

Figure 1:
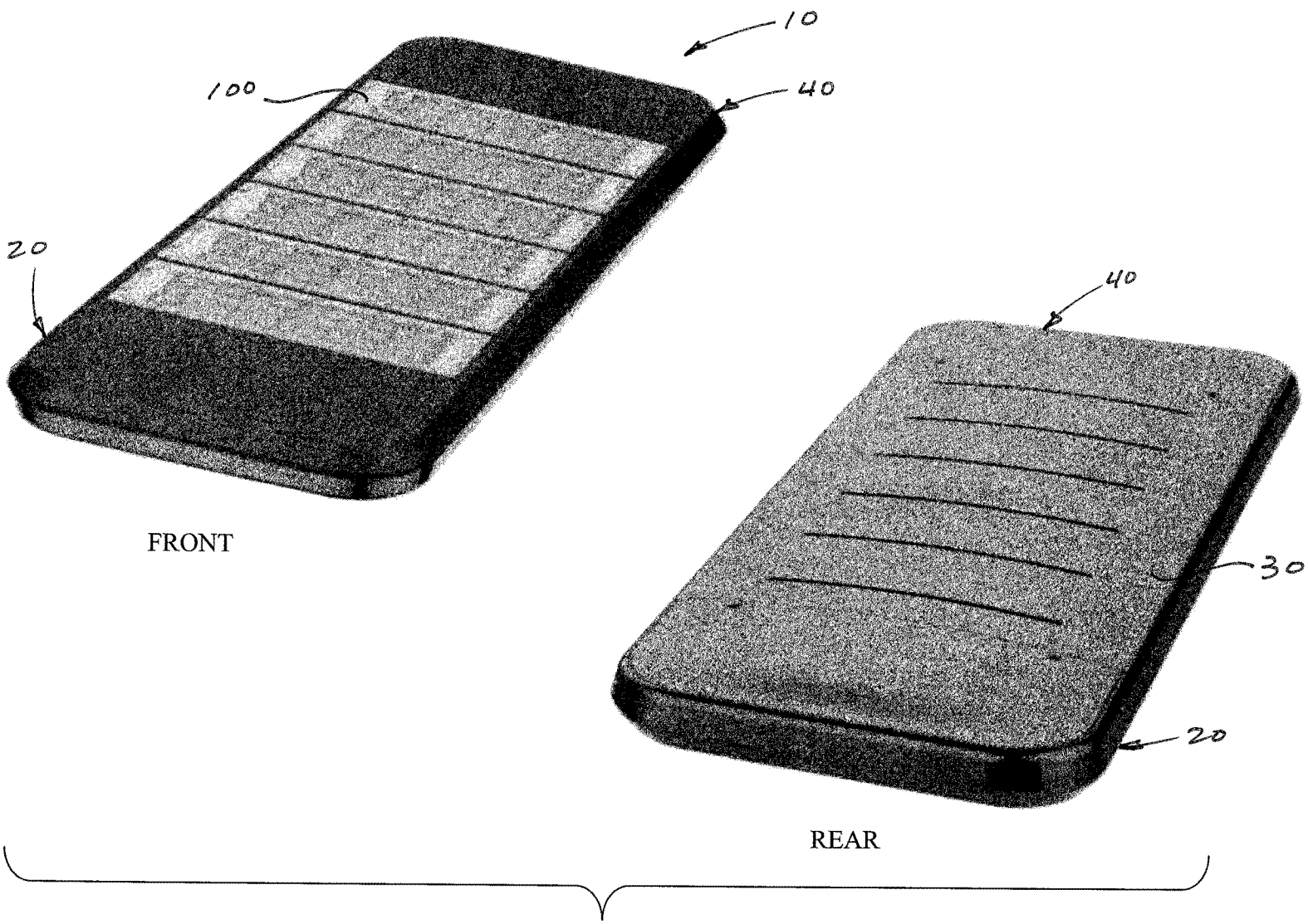
FIG. 1 is perspective front and rear views of a modular light system in accordance with an embodiment of the present invention.
Figure 2:
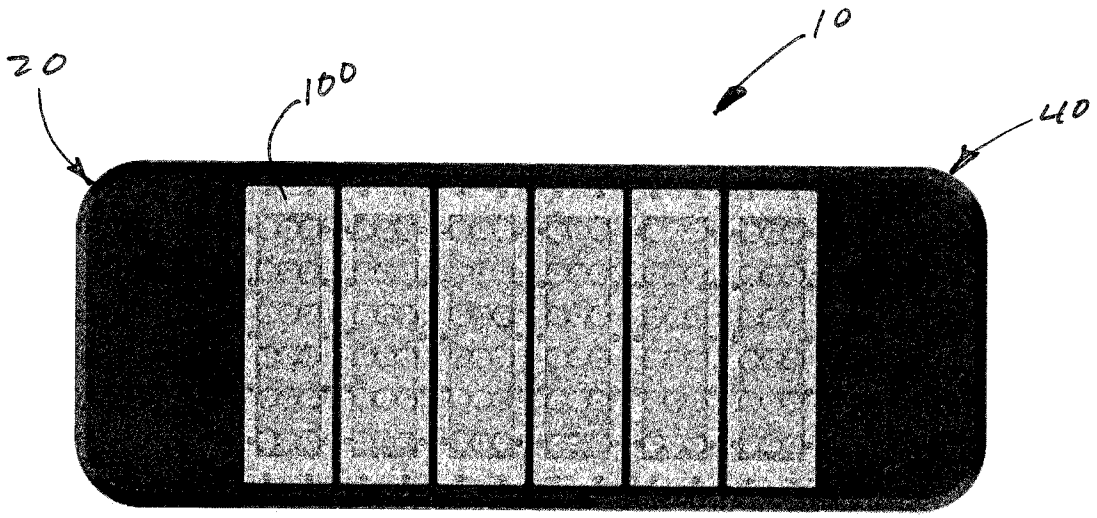
FIG. 2 is a front view of a modular light system in accordance with an embodiment of the present invention.
Figure 8:
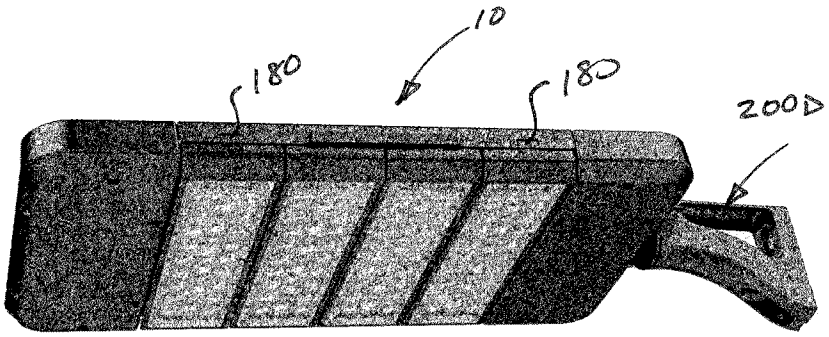
FIG. 8 is a perspective front view of a modular light system and mounting bracket in accordance with an embodiment of the present invention.

The present invention will now be described in detail and with reference to the drawings. Referring first to FIGS. 1, 2 and 8, front and rear views of a modular light system 10 in accordance with an embodiment of the present invention are depicted. The modular light system 10 includes one or more light modules 100, a base module 40, a head module 20, and a rear cover 30 removably latchable with a cover latch 180 (see also FIG. 4). The modular light system 10 is mountable to a structure with a mount 200D, depicted in FIGS. 9A-9E and discussed in more detail below. The modular light system 10 is configurable with one or more light modules 100, the embodiment of FIGS. 1 and 2 having six light modules 100, and the embodiment of FIG. 8 having four light modules 100.

Figure 3:
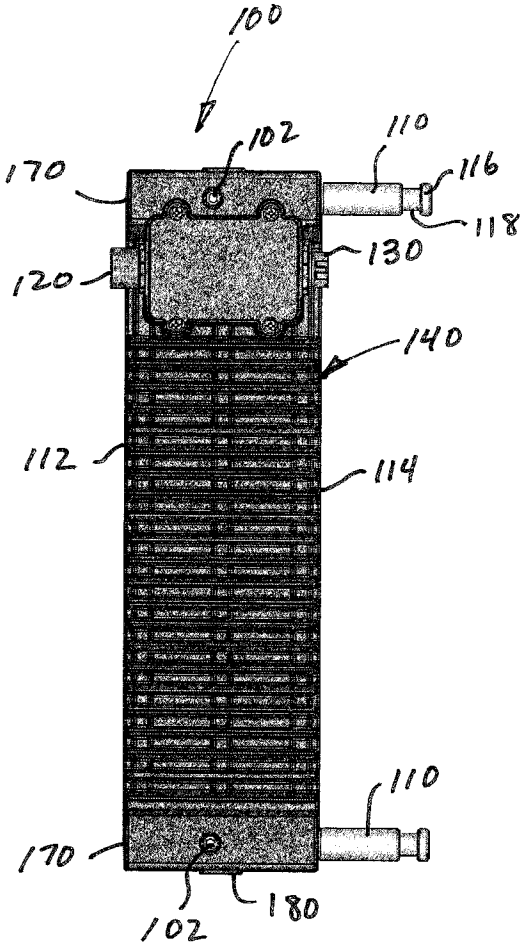
FIG. 3 is a rear view of a light module of a modular light system in accordance with an embodiment of the present invention.
Figure 4:
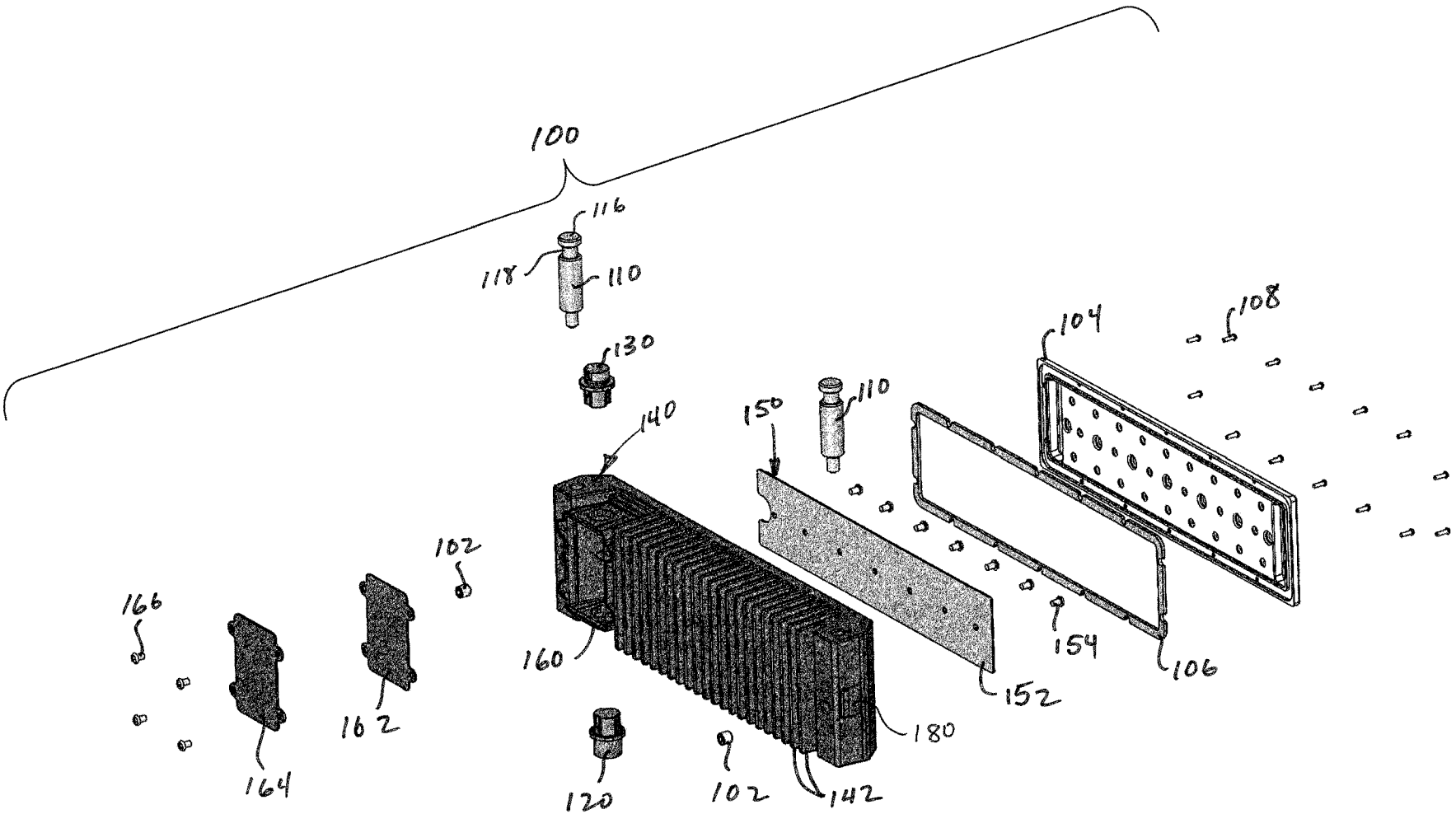
FIG. 4 is an exploded view of the light module of FIG. 3.

Referring next to FIGS. 3 and 4, a light module 100 in accordance with embodiments of the present invention will be discussed in detail. The light module 100 is self-contained and is easily connectable with other light modules 100 or with a base module 40 or head module 20 with mechanical and electrical couplings. The light module 100 comprises a heat sink 140 having a plurality of fins 142 and a first side 112 and a second side 114. The mechanical coupling comprises at least one guide pin 110, preferably two guide pins 110, on the second side 114, with corresponding pin receptacles 170 defined in the first side 112. As will be appreciated by those skilled in the art, the positioning of the guide pins 110 and the guide pin receptacles 170 may be altered between the first and second sides 112, 114, e.g., with one guide pin 110 and one guide pin receptacle 170 being located on each of the first and second sides 112, 114 for engagement therebetween. The guide pin receptacles 170 and guide pins 110 are complementarily sized and shaped so that the guide pins 110 are receivable in the guide pin receptacles 170 when light modules 100 are connected together, or connected with a base module 40 or head module 20.

The electrical coupling comprises a receptacle connector 130 and a plug connector 120 extending from opposite sides of a junction box 160. The receptacle connector 130 extends from a side of the junction box 160 located near the second side 114 of the heat sink 140, and the plug connector 120 extends from a side of the junction box 160 located near the first side 112 of the heat sink 140. The receptacle connector 130 and plug connector 120 provide a pass-through electrical connection for power to flow from one light module 100 to another. At least one of the receptacle connector 130 and plug connector 120 also provides power to the light emitting component 150. The junction box 160 provides an enclosure for the electrical connection between the receptacle connector 130 and the plug connector 120, and for electrical connection of a light emitting component 150 to one or both of the receptacle and plug connectors 130, 120. A gasket 162 and cover 164 are secured to the junction box 160 by a plurality of fasteners 166, such as screws, to sealingly enclose the junction box 160 and protect the components and connections within the junction box 160 from exposure to external elements (e.g., moisture, debris, etc.).

The light module 100 further comprises a solid-state light emitting component 150 comprising a plurality of solid-state light emitting components 154 connected to, and configured as a circuit on a printed circuit board 152. Preferably, the solid-state light emitting components 154 may comprise a plurality of light emitting diodes (LEDs), organic light emitting diodes (OLEDs), and/or polymeric light emitting diodes (PLEDs) arranged in any manner, as a routine matter of design choice. The solid-state light emitting component 150 is electrically connected to one or both of the plug and receptacle connectors 120, 130, and mechanically and thermally connected to the heat sink 140. A gasket 106 and lens 104 are connected to the heat sink 140 with a plurality of fasteners 108, such as screws, to sealingly enclose the solid-state light emitting component 150 and protect the printed circuit board 152 and solid-state light emitting components 154 from exposure to external elements.

Figure 6:
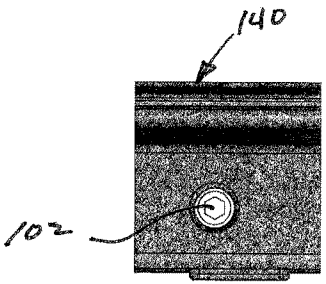
FIG. 6 is a detail view of a lock for connecting components of a modular light system in accordance with an embodiment of the present invention.

A lock 102, as shown in FIG. 6, may be provided with the light module 100, e.g. in the heat sink 140, configured to releasably engage a guide pin 110 of a light module 100 or base module 40 when connected together, as discussed in more detail below. The lock 102 may be a set screw or other element that engages part of a head 116 and/or collar 118 of the guide pin 110, or otherwise blocks removal of the guide pin 110 from the guide pin receptacle 170.

Figure 5:
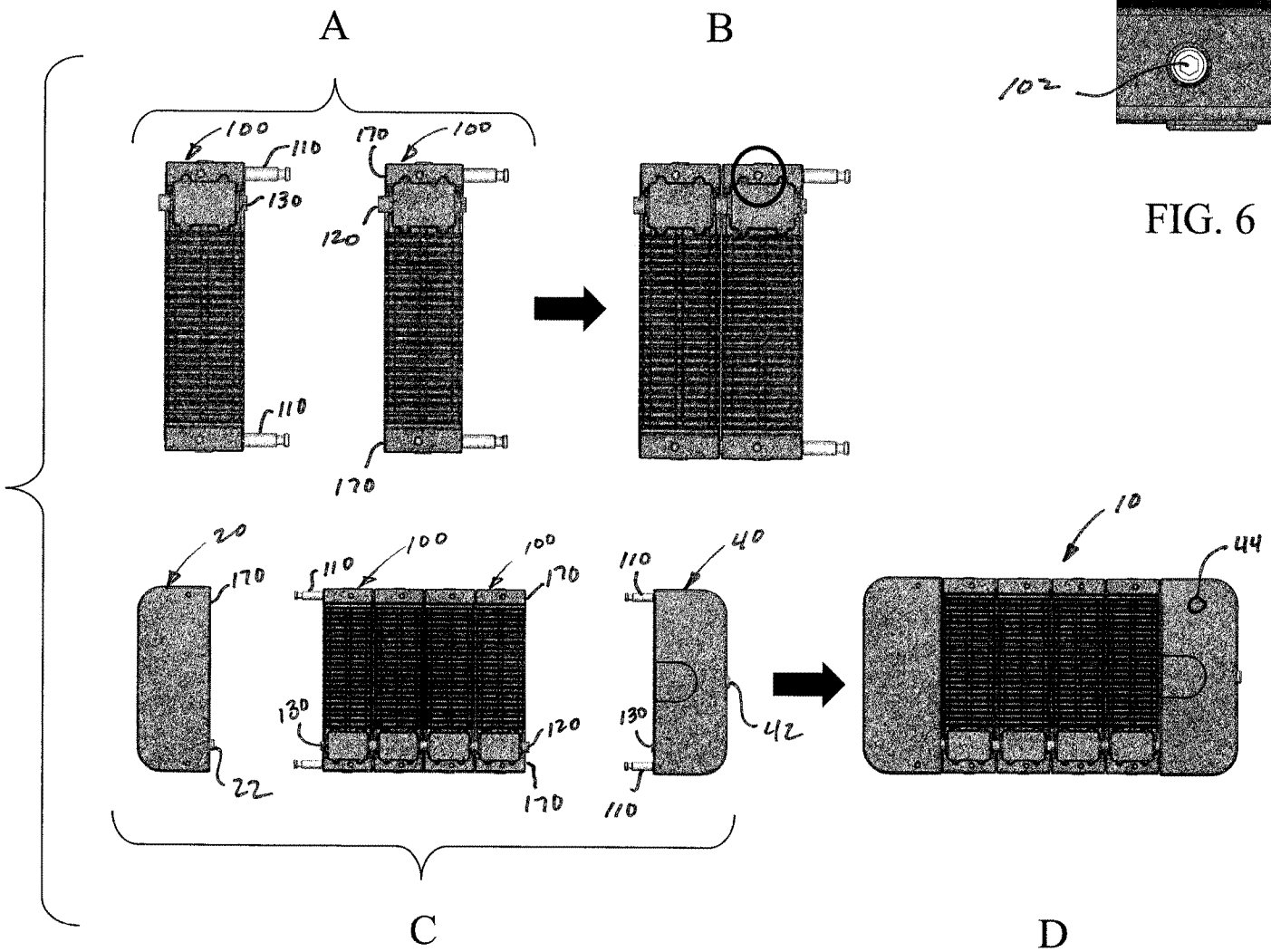
FIG. 5 is an assembly sequence view of a modular light system in accordance with an embodiment of the present invention.
Figure 7:
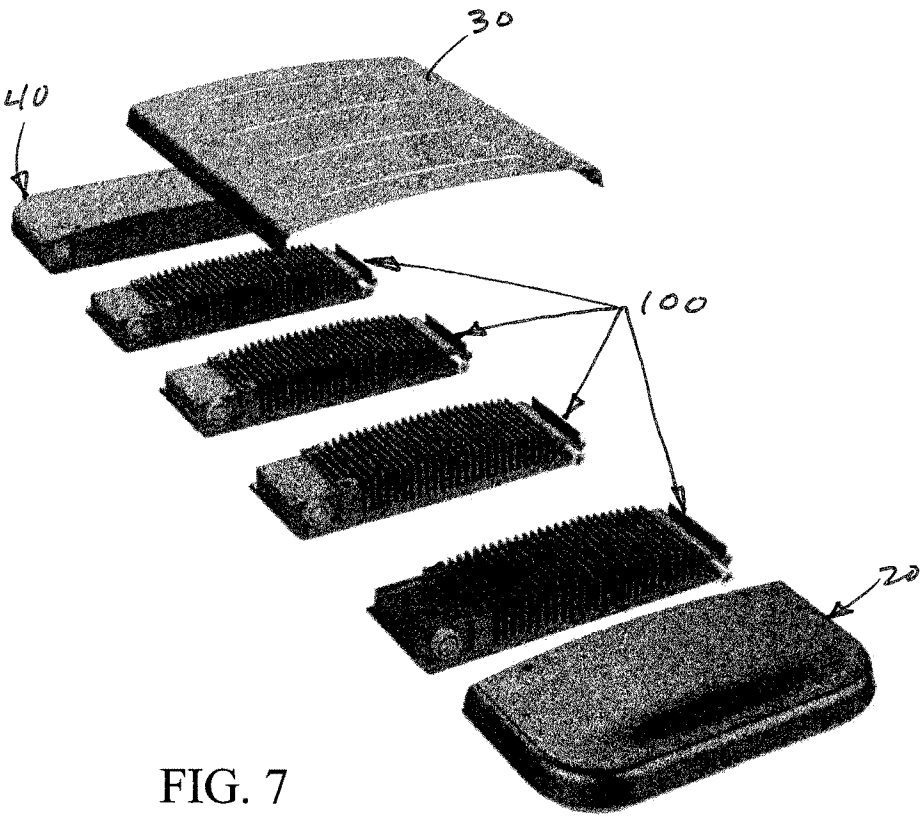
FIG. 7 is an exploded view of a modular light system with four light modules in accordance with an embodiment of the present invention.

One or more light modules 100 can be connected together to create a modular light system 10 in accordance with embodiments of the present invention, as shown in FIG. 7. The present invention advantageously provides flexibility in configuring a light system to accommodate different and varying design constraints and parameters. A modular light system 10 constructed in accordance with embodiments of the present invention contains one or more light modules 100 that are easily assembled and that are bookended by a base module 40 and a head module 20 to complete the modular light system 10. The present invention provides quick connect/disconnect mechanical and electrical couplings that make it easy to assemble and disassemble one or more components of the inventive modular light system 10. For example, a modular light system with four light modules 100 is quickly and easily assembled by coupling four light modules 100 together, and by coupling a base module 40 and head module 20. The light modules 100, base module 40 and head module 20 are releasably mechanically secured to each other by a releasable lock 102, and releasably electrically secured to each other by the plug and receptacle connectors 120, 130. This assembly sequence is depicted in FIG. 5. In views A and B, two light modules 100 are coupled together by inserting the guide pins 110 into the guide pin receptacles 170 and securing them in place with the lock 102 that releasably secures the head of the guide pins in place. The receptacle connector 130 of the light module 100 on the left in view A will connect with the plug connector 120 of the light module 100 on the right. This may be repeated for as many light modules 100 as desired to construct a modular light system 10. Once the desired number of light modules 100 are assembled as described, a base module 40 and head module 20 are assembled, as shown in views C and D. The base module 40 has the same guide pins 110, and the head module 20 has the same guide pin receptacles 170 as the light module 100. Guide pins 110 of the base module 40 will be received in the guide pin receptacles 170 of the rightmost light module 100 of view C, and secured in place by the lock 102 of that light module 100. Similarly, guide pins 110 of the leftmost light module 100 of view C will be received in guide pin receptacles 170 of the head module 20, and the receptacle connector 130 of that light module 100 will electrically connect with the power terminal end connector 22 of the head module 20.

The head module 20 may contain drive circuitry (not shown), e.g., a driver, suitable for providing power to the light modules 100 that make up the modular light system 10. The driver may be configured to convert alternating current power to direct current power useable by the solid-state light emitting components 154. The drive circuitry is designed and configured to provide the power necessary to drive the number of light modules 100 assembled to comprise the modular light system 10 in accordance with embodiments of the present invention. An inventory of drivers may be maintained to allow for a selection based on the number of light modules 100 being used in the modular light system 10. In this manner, efficiency may be provided in selecting a driver more-tailored for a particular application. The inventory of drivers may be selected to cover a range of wattage, such as, 50 watts, 100 watts, 180 watts, and 300 watts. As would be apparent to those skilled in the art, the drive circuitry may include sensors or detectors to determine the number of light modules 100 assembled in the modular light system 10. In addition, or alternatively, the drive circuitry may be designed and configured to provide power and control for a predetermined number of light modules 100. The head module 20 has a plug connector 22 that connects to the drive circuitry.

The base module 40 also contains a power input 42 via which an electrical connection can be made to provide alternating-current power to the modular light system 10. The base module 40 may also include control circuitry (not shown) that may include, by way of non-limiting example, a surge protector, sensor circuitry to detect and control power input to the modular light system, and a photovoltaic sensor 44 to detect changes in ambient light and to control operation of the light modules 100 in response to such detected changes. For example, the sensor 44 may detect a decrease in ambient light, indicating the onset of dusk or evening, and in response may cause the control circuitry in the base module 40 to turn on the LEDs 154 of the light modules 150. Similarly, the sensor 44 may detect an increase in ambient light and cause the circuitry to turn off the LEDs 154. Optionally, the sensor 44 may be a motion sensor.

Alternating-current power which comes through the power input 42 may be electrically conducted through the plug and receptacle connectors 120, 130 to the head module 20, particular to drive circuitry located therein. This electrical conduction can be done through pin and receptacle connections located on the plug and receptacle connectors 120, 130. For example, three pin/receptacle connections at each plug/receptacle connector 120, 130 interface may be utilized to provide, respectively, power supply (hot line), return and ground for the incoming alternate current power. Additional pin/receptacle connections at each plug/receptacle connector 120, 130 may be provided to carry direct current from the driver circuitry (e.g., driver converted direct current power) to each of the light modules 100 (e.g., two pins at each interface—one direct-current supply and one direct-current return). Further, pin/receptacle connections may be provided at each plug/receptacle connector 120, 130 to conduct control signals, such as dimming signals, dark/light sensor detection, motion detection, etc.

Optionally, the drive circuitry may be located in the base module 40 and/or within each of the light modules 100.

It is possible to provide direct-current power, e.g., by a battery pack, in lieu of or in addition to alternating current power, to the modular light system 10 from either externally and/or from within. This may obviate the need for a driver. Emergency battery back-up may be provided to supply direct current in the event of a power failure. By-passing of the driver may be provided for as needed.

Figure 9A:
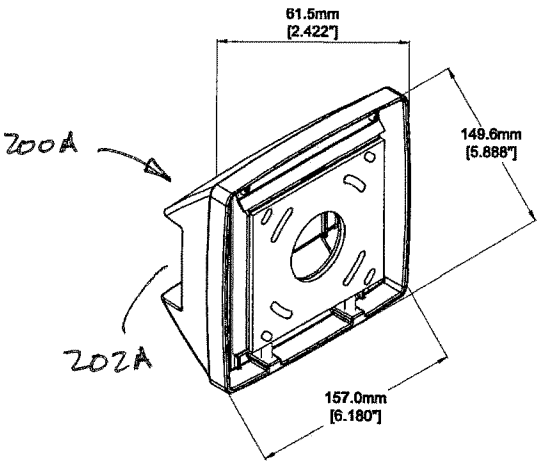
FIGS. 9A-9E are mounting brackets for a modular light system in accordance with embodiments of the present invention.
Figure 9B:
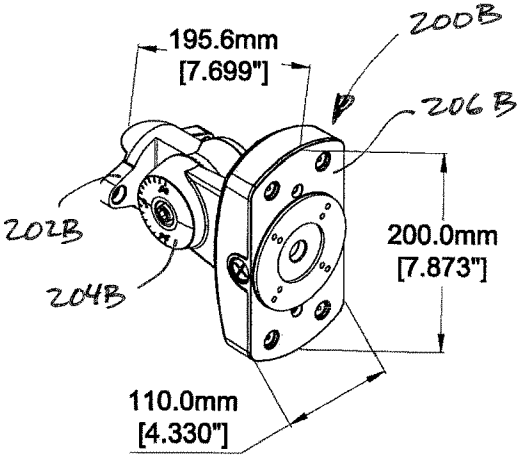
Figure 9C:
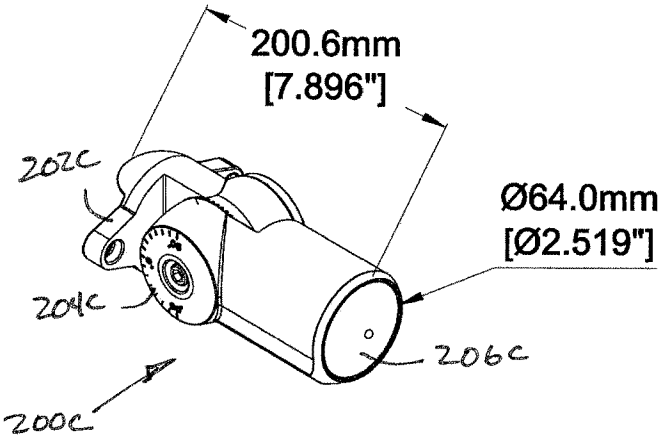
Figure 9E:
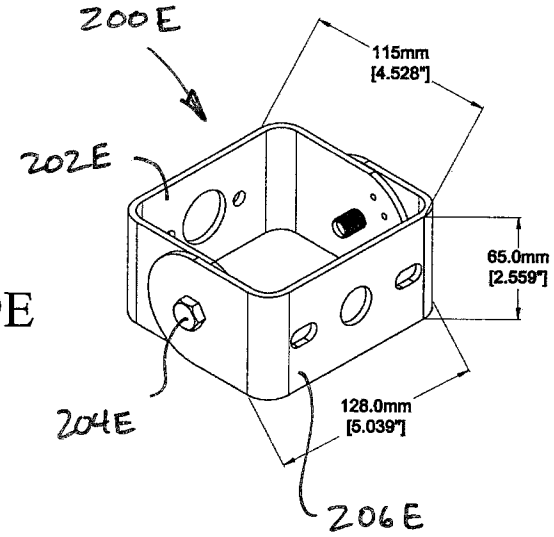
Figure 9D:
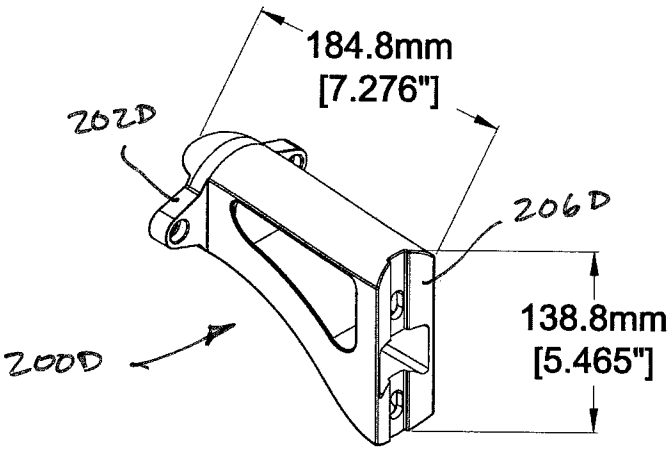

The modular light system 10 of the present invention is installable in a variety of configurations (e.g., a variety of number of light modules 100), and in a variety of locations. A plurality of different mounts are depicted in FIGS. 9A-9E, each of which is fastenable to the base module 40, and to the structure to which the modular light system 10 is to be secured. For mounting to a flat surface such as a wall, a wall pack mount 200A, as shown in FIG. 9A, may be used. A channel 202A is defined in the mount 200A that is sized and shaped to receive a part of the base module 40. The base module 40 is securable to the mount 200A using screws or other similar fasteners, and the mount 200A is similarly securable to a wall. Alternatively, a knuckle surface mount 200B, as depicted in FIG. 9B, may be used to mount the modular light system 10 to a flat surface. This mount 200B includes a surface mount part 206B and a light system mount part 202B that are connected together by a knuckle part 204B that enables angular adjustment of the modular light system 10 once the mount 200B is secured to the surface. The surface mount part 206B is sized and shaped for mounting to a generally flat surface, and the light system mount part 202B is sized and shaped to mount to the base module 40. Similarly, a knuckle slip-fit mount 200C, as depicted in FIG. 2C, includes a light system mount part 202C and a slip-fit mount part 206C that is sized and shaped to receive and accommodate a pole, peg, or the like. While the interior shape of the slip-fit mount part 206C shown in FIG. 9C is circular or tubular, other geometric shapes and configurations are contemplated by, and within the scope and spirit of the present invention. The slip-fit mount part 206C and light system mount part 202C are connected together by a knuckle part 204C that enables angular adjustment of the modular light system 10. A pole mount 200D is depicted in FIG. 9D and includes a pole mount part 206D and a light system mount part 202D. The pole mount part 206D is depicted as being generally arcuate to accommodate a tubular pole. However, the pole mount part 206D of this embodiment may also be sized and shaped to accommodate a rectangular, square or other geometrically shaped pole. A trunnion mount 200E is depicted in FIG. 9E and has a light system mount part 202E and a surface mount part 206E. An adjustable pivot 204E is provided between the light system mount part 202E and surface mount part 206E to enable adjustment of the modular light system 10 once it has been installed.

Modifications to embodiments of the present invention are possible without departing from the scope of the invention as defined by the accompanying claims. Expressions such as "including," "comprising," "incorporating," "consisting of," "have," "is," used to describe and claim the present invention are intended to be construed in a non-exclusive manner, namely allowing for items, components or elements not explicitly described herein also to be present. Reference to the singular is to be construed to relate to the plural, where applicable.

What is claimed is:

1. A modular light system comprising:

a light module comprising:

a heat sink having a first side with a first mechanical coupling and a second side with a second mechanical coupling;

a solid-state light emitting component connected to the heat sink; and a junction box with a first electrical coupling and a second electrical coupling, at least one being electrically connected to the solid-state light emitting component;

a base module removably coupled with the light module by the first mechanical coupling and the first electrical coupling; and a head module removably coupled with the light module by the second mechanical coupling and the second electrical coupling, the head module having a power terminal end connector connectable with the second electrical coupling.

2. The modular light system of claim 1, wherein the first mechanical coupling comprises an aperture defined in the first side of the heat sink and a lock extending at least partially into the aperture.

3. The modular light system of claim 2, wherein the second mechanical coupling comprises a guide pin extending from the second side of the heat sink.

4. The modular light system of claim 1, wherein the second mechanical coupling comprises a guide pin extending from the second side of the heat sink.

5. The modular light system of claim 1, wherein the first electrical coupling is one of a plug and a receptacle, and the second electrical coupling is the other one of a plug and a receptacle.

6. The modular light system of claim 1, wherein the first electrical coupling is a plug, and the second electrical coupling is a receptacle.

7. The modular light system of claim 1, wherein the light module further comprises a lens and a gasket connectable to the heat sink to sealingly cover the solid-state light emitting component.

8. The modular light system of claim 1, further comprising a plurality of solid-state light emitting components.

9. The modular light system of claim 1, further comprising a mount connected to the base module to secure the modular light system to a support.

10. The modular light system of claim 9, wherein the mount comprises one of a wall pack mount, a knuckle surface mount, a knuckle slip-fit mount, a pole mount and a trunnion mount.

11. The modular light system of claim 1, further comprising a sensor in the base module configured to detect changes in an environmental condition.

12. The modular light system of claim 11, wherein the sensor is configured to detect changes in ambient light.

13. The modular light system of claim 1, further comprising drive circuitry in the head module.

14. The modular light system of claim 1, further comprising control circuitry in the base module.

15. The modular light system of claim 1, wherein the base module has a connection for power input to the modular light system to provide power to the solid-state light emitting component.

16. A modular light system comprising:

a first light module comprising:

a first heat sink having a first side with a first mechanical coupling and a second side with a second mechanical coupling;

a first solid-state light emitting component connected to the first heat sink; and a first junction box with a first electrical coupling and a second electrical coupling, at least one being electrically connected to the first solid-state light emitting component;

a second light module comprising:

a second heat sink having a first side with a first mechanical coupling and a second side with a second mechanical coupling;

a second solid-state light emitting component connected to the second heat sink; and a second junction box with a first electrical coupling and a second electrical coupling, at least one being electrically connected to the second solid-state light emitting component;

a base module removably coupled with the first light module by the first mechanical coupling and the first electrical coupling; and a head module removably coupled with the second light module by the second mechanical coupling and the second electrical coupling, the head module having a power terminal end connector connectable with the second electrical coupling.

17. The modular light system of claim 16, wherein the first mechanical coupling of each of the first heat sink and second heat sink comprises an aperture defined in the first side of each of the first heat sink and second heat sink, and a lock extending at least partially into the aperture.

18. The modular light system of claim 17, wherein the second mechanical coupling of each of the first heat sink and second heat sink comprises a guide pin extending from the second side of each of the first heat sink and second heat sink.

19. The modular light system of claim 16, wherein the second mechanical coupling of each of the first heat sink and second heat sink comprises a guide pin extending from the second side of each of the first heat sink and second heat sink.

20. The modular light system of claim 16, wherein the first electrical coupling of each of the first junction box and second junction box is one of a plug and a receptacle, and the second electrical coupling is the other one of a plug and a receptacle.

21. The modular light system of claim 16, wherein the first electrical coupling of each of the first junction box and second junction box is a plug, and the second electrical coupling is a receptacle.

22. The modular light system of claim 16, wherein each of the first and second light modules further comprise a lens and a gasket connectable respectively to the first heat sink and second heat sink to sealingly cover the first and second solid-state light emitting component.

23. The modular light system of claim 16, further comprising a mount connected to the head module to secure the modular light system to a support.

24. The modular light system of claim 23, wherein the mount comprises one of a wall pack mount, a knuckle surface mount, a knuckle slip-fit mount, a pole mount and a trunnion mount.

25. The modular light system of claim 16, further comprising a sensor in the base module and configured to detect changes in an environmental condition.

26. The modular light system of claim 25, wherein the sensor is configured to detect changes in ambient light.

27. The modular light system of claim 16, further comprising drive circuitry in the head module.

28. The modular light system of claim 16, further comprising control circuitry in the base module.

29. The modular light system of claim 16, wherein the base module has a connection for power input to the modular light system to provide power to the first solid-state light emitting component.

* * * * *